United States Patent [19]

Setele

[11] Patent Number: 4,884,616

[45] Date of Patent: Dec. 5, 1989

[54] VERTICAL BLIND LOUVER HAVING TRANSPARENT GROOVED SIDE EDGES

[75] Inventor: Richard A. Setele, Newbury Park, Calif.

[73] Assignee: Home Fashions, Inc., Santa Monica, Calif.

[21] Appl. No.: 248,546

[22] Filed: Sep. 23, 1988

[51] Int. Cl.[4] ..... E06B 9/36

[52] U.S. Cl. ..... 160/236

[58] Field of Search ..... 160/236; 169/42; 350/263

[56] References Cited

U.S. PATENT DOCUMENTS 4,628,980 12/1986 LeHouillier ..... 160/236 X

*Primary Examiner*—Blair M. Johnson

*Attorney, Agent, or Firm*—Welsh & Katz

[57] ABSTRACT

A slat, suitable for use as a vertical blind louver, having an upper and lower surface, having an opaque central section composed of a first chemical composition having a first melt temperature, and having transparent first and second side edges composed of a second chemical composition having a second melt temperature substantially greater than the first melt temperature, wherein the side edges are integrally fused to the central section, each side edge contains a longitudinal groove open to the central section, and the grooves open to the same surface of the slat. In a preferred embodiment the first composition is a polyvinylchloride and the second composition is a polycarbonate having a melt temperature which is 100° to 150° F. higher than the polyvinylchloride melt temperature. Novel extrusion dies for forming the slat are also disclosed.

20 Claims, 4 Drawing Sheets

VERTICAL BLIND LOUVER HAVING TRANSPARENT GROOVED SIDE EDGES

BACKGROUND OF THE INVENTION

The present invention relates to window coverings and in particular, to a coextruded vertical blind louver having transparent grooved side edges, and to coextrusion dies suitable for use in extruding a slat for use as a louver.

Vertical blinds are well known in the field of interior decorating. They are similar to fabric drapes in that they are generally used to cover a window or a sliding glass door. Like fabric drapes, they may be center opening or side opening. The center opening vertical blind opens in the middle of the blind and the two halves withdraw to the two sides of the window to leave a center opening. The side opening vertical blind withdraws from one side to the other side of the window to leave a side opening.

Vertical blinds differ from fabric drapes in that the vertical blind contains a plurality of individual vanes or louvers which are similar to the slats of a venetian blind. However, the venetian blind has slats which are horizontal whereas the vertical blind has vertically suspended slats. Moreover, the vertical blind differs from the fabric drape in that the vertical blind may be at least partially open when, in fact, it remains closed. This is accomplished by a mechanical means whereby the individual vanes or louvers of the blind, which are hanging suspended from overhead, may be turned from a fully open to a fully closed position while the entire blind remains fully extended across the window or door. In addition, the vertical blind may be adjusted so that the individual louvers or vanes are oriented in a position which is intermediate to being turned fully opened or fully closed. In this manner, the vertical blind has a maximum flexibility for keeping sunlight out of the room. For this reason, the vertical blind has gained great popularity at the expense of the conventional fabric drape.

Vertical blinds currently are available with vertical louvers which fall into four major categories. The louvers may be free hanging fabric, fabric supported on a rigid vinyl shell, aluminum or rigid vinyl. Each of these four types of louvers may display different colors and patterns according to the taste of the individual purchaser. It is estimated that rigid vinyl louvers presently account for about 35 percent of all sales of vertical blinds. These louvers are produced from a rigid vinyl containing a pigmentation system which makes the louver highly opaque in order to reduce light transmission.

One type of rigid vinyl vane or louver which is popular is a louver which has side edges which include longitudinal slots or grooves running along the full length of the louver. These slots are open to the center web of the louver and are adapted to receive a color insert. The color insert may be pushed into the slots at one end of the louver and then slid along the louver surface until the color insert covers the full length and width of the louver with a new color or pattern. This allows the drapery owner to redecorate at his convenience. The owner can paint his room a new color and then, by use of new inserts, he can change the color of his vertical blind to conform to or contrast with the new color of the room. This grooved louver thus affords the owner maximum flexibility in color coordinating the vertical blind according to his needs or his whim.

Some louvers have side edges which contain grooves on both surfaces of the louver. Such louvers can have a color insert of a first color on one side and a second color on the other side. Thus, the owner of the vertical blind can have one color exposed to the room and the second color exposed to the window, as he may desire. The owner may then adjust the vertical blind to reposition the individual louvers so that the colors are reversed without changing the color inserts.

The grooved louvers described above normally have a central section or base web of a rigid vinyl which is pigmented and opaque to minimize light transmission. The grooved or slotted edges, however, are generally rigid vinyl of a clear and transparent type. This clear and transparent vinyl is used so that the edge portion of the color insert which is held in the slot or groove remains visible to the viewer.

Such clear vinyl is subject to aging caused primarily by exposure to the ultraviolet radiation component of sunlight. Among other things, the aging causes the clear vinyl to discolor so that the edge portions of the color insert appear yellowed. Other aging effects include the fact that the vinyl degrades and becomes brittle.

It is, therefore, an object of the present invention to provide a vertical blind louver having clear transparent grooved or slotted side edges which have enhanced resistance to discoloration and degradation upon prolonged exposure to sunlight.

It is also an object of the present invention to provide a novel extrusion die for producing the improved louver with the improved transparent grooved side edges.

These and other objects of the invention, as well as the advantages thereof, will become more clear from the disclosure which follows.

SUMMARY OF THE INVENTION

The present invention resides in the discovery that the transparent grooved side edges of a rigid vinyl louver, which heretofore have been made of a clear transparent rigid polyvinylchloride, can now be made of a clear transparent polycarbonate. The polycarbonate is more resistant to aging than the rigid vinyl and its beneficial physical properties are retained for a longer period of time. More particularly, the polycarbonate is more resistent to ultraviolet radiation so that it does not discolor or become brittle upon prolonged exposure to sunlight.

Another aspect of the present invention is the design of novel extrusion dies which are capable of fabricating the improved drapery louver having the grooved side edges. The combination of the rigid vinyl with a clear transparent polycarbonate can present significant problems as the two materials have widely different melt temperatures, differing by as much as 100° to 150° F. Thus, the design of the die becomes important. If the polycarbonate melt is cooled too much within the die, the extruded polycarbonate side edges may fail to fuse properly with the extruded central web or center section of polyvinylchloride as the louver coextrudate exits from the die face. Moreover, if the cooling is excessive, the polycarbonate may begin to form gels within the die and may eventually set up and plug the die passageways. On the other hand, care must be also taken to be sure that the polyvinylchloride in the central web is not overheated, since overheating may cause the vinyl to begin to decompose.

Accordingly, therefore, in one broad embodiment, the present invention comprehends a slat, suitable for use as a vertical blind louver, having an upper surface and a lower surface, having first and second ends, having a central section composed of a first chemical composition having a first melting temperature, and having first and second side edges composed of a second chemical composition having a second melt temperature substantially different from the first melt temperature, wherein said side edges are fused to said central section. In a broad aspect, the second melt temperature may be lower or higher than the first melt temperature.

In another embodiment, the present invention comprehends a slat, suitable for use as a vertical blind louver, having an upper surface and a lower surface, having first and second ends, having an opaque central section composed of a first chemical composition having a first melt temperature, and having transparent first and second side edges composed of a second chemical composition having a second melt temperature substantially greater than the first melt temperature, wherein the side edges are integrally fused to the central section, each side edge contains a longitudinal groove open to the central section, and both grooves open to the same surface of the slat.

More particularly, the present invention comprehends such a slat having grooved side edges wherein the first composition comprises a polyvinylchloride and the second composition comprises a polycarbonate.

In addition, the present invention comprehends a first extrusion die assembly, suitable for use in extruding a slat for use as a vertical blind louver, which comprises in combination:

(a) a gate member having an inlet face and an outlet face, and having a central passageway therethrough, the gate member central passageway having an inlet opening in the inlet face and having a slot outlet opening in the outlet face, with the slot outlet opening having a height substantially less than the inlet opening height;

(b) an insulating member mounted on the outlet face of the gate member, the insulating member having an outlet face and an inlet face adjacent to the gate member outlet face, and having a central passageway therethrough, the insulating member central passageway having a slot inlet opening in the inlet face contiguous and substantially congruent with the gate member outlet opening, and having a slot outlet opening in the outlet face of smaller height than the insulating member inlet opening;

(c) an adapter member mounted on the outlet face of the insulating member, the adapter member having an outlet face and an inlet face adjacent to the insulating member outlet face, and having a central passageway therethrough, the adapter member central passageway having a slot inlet opening in the inlet face contiguous and substantially congruent with the insulating member outlet opening and having a slot outlet opening in the outlet face of smaller height than the adapter member slot inlet opening;

(d) a die body member mounted on the outlet face of the adapter member, the die body member having an outlet face and an inlet face adjacent to the adapter member outlet face, and having a central passageway therethrough, the die body member central passageway having a central slot inlet opening in the inlet face contiguous and substantially congruent with the adapter member outlet opening and having a central slot outlet opening in the outlet face of smaller height than the die body member central slot inlet opening;

(e) a peripheral surface on the die body member, positioned between the die body member inlet and outlet faces, and containing a peripheral inlet opening;

(f) a vertex outlet opening in the die body member inlet face spaced from the die body member central slot inlet opening;

(g) a peripheral passageway in the die body member communicating the peripheral inlet opening with the vertex outlet opening;

(h) first and second side slot inlet openings in the die body member inlet face adjacent to the die body member central slot inlet opening and in substantial linear alignment therewith;

(i) first and second side passageways in the die body member, extending from the first and second side slot inlet openings and terminating in openings in the sides of the die body member central passageway intermediate the inlet and outlet faces of the die body member; and (j) first and second recesses in the die body member inlet face, extending from the vertex outlet opening to the first and second side slot inlet openings, whereby the peripheral inlet opening is in communication with the first and second side slot inlet openings.

The present invention also comprehends a second extrusion die assembly, suitable for use in extruding a slat for use as a vertical blind louver, which comprises in combination:

(a) a gate member having an inlet face and an outlet face, and having a central passageway therethrough, the gate member central passageway having an inlet opening in the inlet face and having a slot outlet opening in the outlet face, with the slot outlet opening having a height substantially less than the inlet opening height;

(b) a lower adapter member mounted on the lower portion of the outlet face of the gate member, the lower adapter member having an outlet face and an inlet face adjacent to the gate member outlet face, and having a central passageway therethrough, the lower adapter member passageway having a slot inlet opening in the lower adapter member inlet face contiguous and substantially congruent with the gate member outlet opening, and having a slot outlet opening in the lower adapter member outlet face of smaller height than the lower adapter member inlet opening height;

(c) a lower die body member mounted on the outlet face of the lower adapter member, the lower die body member having an outlet face and an inlet face adjacent the lower adapter member outlet face, and having a central passageway therethrough, the lower die body member passageway having a central slot inlet opening in the lower die body member inlet face contiguous and substantially congruent with the lower adapter member outlet opening, and having a central slot outlet opening in the lower die body member outlet face of smaller height than the lower die body member inlet opening height;

(d) first and second side slot inlet openings in the lower die body member inlet face adjacent to the lower die body member central slot inlet opening and in substantial linear alignment therewith;

(e) first and second side passageways in the lower die body member, extending from the first and second side slot inlet openings and terminating in openings in the sides of the lower die body member central passageway intermediate the inlet and outlet faces of the lower die body member;

(f) first and second recesses in the inlet face of the lower die body member, extending upwardly from the first and second side slot inlet openings to the top of the lower die body member;

(g) an insulating member mounted on the top of the lower adapter member and the lower die body member, the insulating member having first and second apertures in alignment with the first and second recesses of the lower die body member;

(h) an upper adapter member mounted on the insulating member above the lower adapter member, the upper adapter member having an outlet face and an inlet face spaced from the upper portion of the outlet face of the gate member, having an upper periphery containing a peripheral inlet opening, having a peripheral passageway extending from the peripheral inlet opening to a vertex outlet opening in the upper portion of the outlet face of the upper adapter member, and having first and second recesses in the upper adapter member outlet face extending from the vertex outlet opening to the first and second apertures in the insulating member; and (i) an upper die body member mounted on the insulating member above the lower die body member, the upper die body member having an outer face and an inner face adjacent to the upper adapter member outer face.

In a further embodiment of the foregoing second extrusion die assembly, the upper die body member contains first and second recesses in the inlet face of the upper die body member, extending upwardly from the first and second apertures of the insulating member and substantially contiguous with said first and second recesses of the upper adapter member, and terminating in a vertex recess contiguous with the vertex outlet opening of the upper adapter member.

In a still further embodiment of the foregoing second extrusion die assembly, the lower adapter member contains first and second recesses in the outlet face of the lower adapter member, extending downwardly from the first and second apertures of the insulating member and substantially contiguous with the first and second recesses of the lower die body member, and terminating in the slot outlet opening of the lower adapter member.

An understanding of the present invention may be readily accomplished from the following description which is to be read in light of the accompanying drawings.

DESCRIPTION OF THE PREFERRED EMBODIMENT

Figure 1:
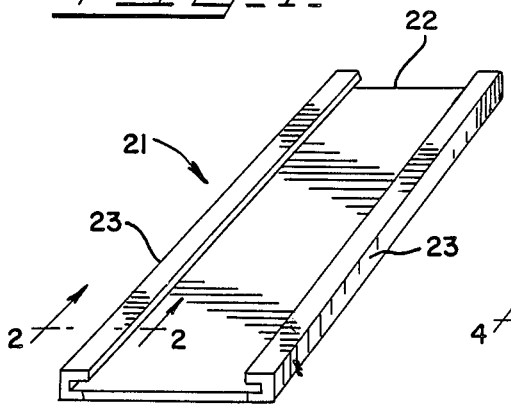
FIG. 1 is a simplified perspective view of a vertical blind louver having single groove side edges.
Figure 2:
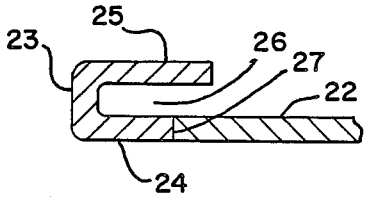
FIG. 2 is an enlarged schematic cross-sectional representation of one corner of the end of the vertical blind louver of FIG. 1, as seen along section line 2—2 of FIG. 1.

Referring now to FIGS. 1 and 2, there is shown a vertical blind louver 21 containing transparent side edges 23 which define a single groove. Side edges 23 are fused to a pigmented base web or central section 22. As seen more clearly in FIG. 2, side edges 23 include an edge base 24 which is fused and merged with the central section or base web 22 at a fusion interface 27. Also shown in FIG. 2 are the edge finger 25 of the single groove edge 23 which defines a groove or slot 26 which opens towards the louver central section 22 on the upper surface thereof.

Figure 3:
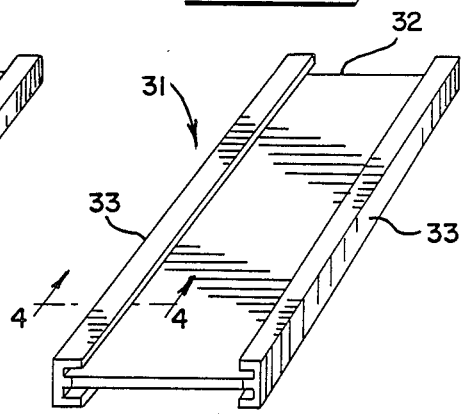
FIG. 3 is a simplified perspective view of a vertical blind louver having double groove side edges.
Figure 4:
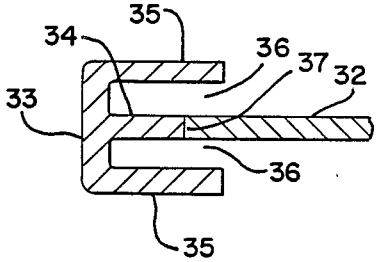
FIG. 4 is an enlarged schematic cross-sectional representation of one corner of the end of the vertical blind louver of FIG. 3, as seen along section line 4—4 of FIG. 3.

Referring now to FIGS. 3 and 4, there is shown a slat defining a double grooved louver 31 which is grooved at the upper and lower surfaces. The louver contains a pigmented central section or base web 32 between transparent double grooved edges 33. As seen more clearly in FIG. 4, the double grooved edges 33 have upper and lower edge fingers 35, which define upper and lower slots 36 between the fingers 35 and the edge base 34. The double grooved edge 33 is fused and integrally held to the pigmented base web 32 at a fusion interface 37.

Figure 5:
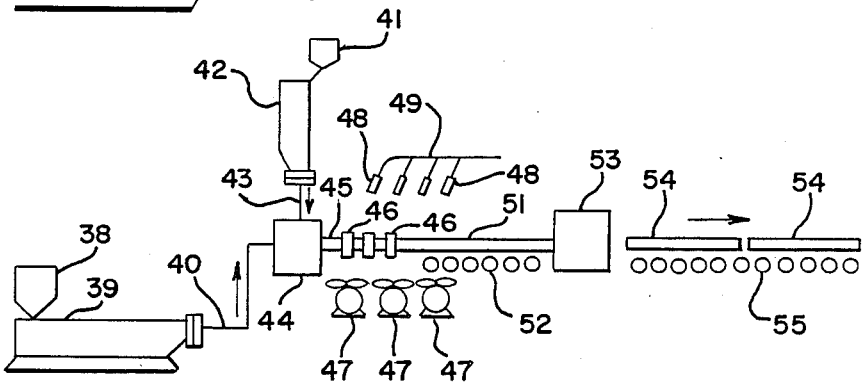
FIG. 5 is simplified schematic flow diagram showing the method of manufacture of the vertical blind louver of FIG. 1 and the louver of FIG. 2.

FIG. 5 shows a simplified schematic flow diagram which illustrates the method and equipment utilized to produce the drapery louver of the present invention. For purposes of illustration it is assumed that the process of FIG. 5 is producing a single grooved drapery louver. FIG. 5 shows a resin hopper 38 for polyvinylchloride resin, which feeds a main extruder 39. Main extruder 39 discharges the melted polyvinylchloride resin via a conduit 40 to a central inlet in extrusion die assembly 44. Also shown is a resin hopper 41 for polycarbonate resin, which feeds a coextruder 42. Coextruder 42 passes melted polycarbonate resin via line 43 to an upper inlet in the extrusion die assembly 44. Coextruder 42 is preferably mounted in a vertical orientation above die 44, as shown, but it may also be horizontally oriented or inclined at angle.

The coextruded extrudate is discharged from the extrusion die assembly 44 as a molten extrudate 45 having the shape of a grooved louver having single grooves in the side edges. The hot extrudate is not capable of holding its own shape in the molten form, and it passes directly to a plurality of guide formers 46. The first guide former 46 is generally positioned about three inches away from the die face and each succeeding guide former 46 is spaced along the length of extrudate at about three inch intervals. The plurality of edge formers 46 extends for a ten foot length along the direction of motion for the extrudate. The groove formers are described more fully hereinafter in relation to FIGS. 6 and 7. The guide formers are required because the hot extrudate will not maintain its shape until it has been cooled to a gel form and this does not occur until the polycarbonate has been cooled from an exit temperature above 500° F. to a cooler temperature of about 160° F.

The extrudate is cooled in a conventional manner, such as by a plurality of cooling air fans 47 moving ambient air, or by a plurality of cooling air nozzles 48 which are fed cooling air by means of an air manifold 49. The preferred operation is to use a rack of cooling fans 47 below the hot extrudate, as shown, with a second rack of fans above the hot extrudate. The fans preferably have squirrel cage rotors. The cooled extrudate is further cooled until it sets up into a rigid slat 51 which is then transferred along the process flow by means of a conveyer system 52 which is schematically represented by a plurality of rollers.

The rigid slat enters a severing station 53 which also may include elements which punch apertures into the louver base web 22 at each end of the severed rigid slat. These apertures, which are not shown in FIG. FIG. 1, are conventionally found in the louver slats at each end in order that the louver slat may be secured to the overhead cords of the vertical blind. FIG. 5 illustrates two severed discrete lengths 54 of a single groove louver being discharged from the severing station 53 and taken away by means of a conveyor system 55, schematically represented by a plurality of rollers.

Figure 6:
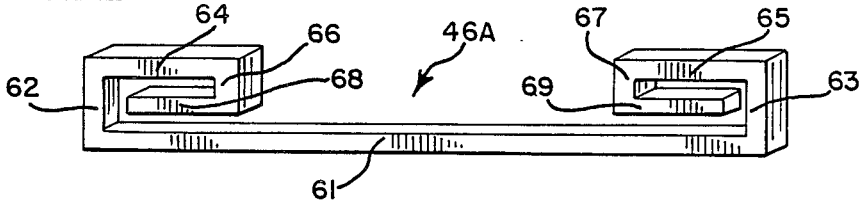
FIG. 6 is a simplified perspective view of a louver guide former used for producing a vertical blind louver having single groove side edges.

FIG. 6 illustrates a single groove guide former 46A which is utilized to fabricate the louver 21 of FIG. 1. The single groove guide former 46A has a horizontal base member 61. At the right end of the horizontal base member 61 is a right upstanding member 62, a right inwardly extending arm 64, a right depending knuckle 66, and a right outwardly extending finger 68. At the left end of base member 61 there is a left upstanding member 63, a left inwardly extending arm 65, a left depending knuckle 67, and a left outwardly extending finger 69. From the structure of this single groove guide former 46A, those skilled in the art will recognize that the extrudate which leaves the outlet face of the extrusion die assembly 44 will be supported upon the upper surface of the base member 61, the upper surface of the right extending finger 68, and the upper surface of the left extending finger 69. These members 61, 68 and 69 give support to the molten extrudate and help form the groove 26 which appears at each edge of the single groove louver slat 21. The guide former 46A is supported by bracket means, not shown, upon the frame or rack which supports the lower cooling fans 47 which are cooling the extrudate from below.

Figure 7:
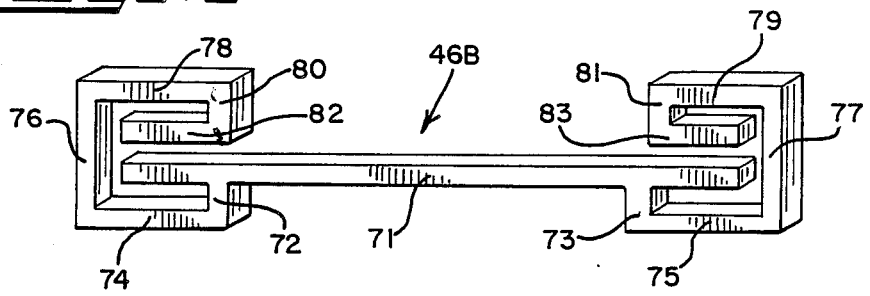
FIG. 7 is a simplified perspective view of a louver guide former used for producing a vertical blind louver having double groove side edges.

FIG. 7 discloses a guide former 46B for a double grooved louver slat such as that illustrated in FIG. 3. The guide former 46B has a base member 71 in horizontal position. At the right end of the base member 71 is a right depending member 72 which is set inwardly a short distance. Extending from the right depending member 72 is a right outwardly extending arm 74. Right upstanding member 76 extends upwardly from the right outwardly extending arm 74. A right inwardly extending arm 78 is supported cantilever fashion from the right upstanding member 76. A right depending knuckle 80 leaves the end of the right inwardly extending arm 78 and ends in a right extending finger 82 which is cantilevered outwardly. At the left end of the base member 71, and set inwardly a short distance, is a left depending member 73. Extending from depending member 73 is a left outwardly extending arm 75. Left upstanding member 77 is supported by the left outwardly extending arm 75. A left inwardly extending arm 79 is supported in a cantilever fashion by the left upstanding member 77. The inward end of the left inwardly extending arm 79 has a left depending knuckle 81 which terminates in a left outwardly extending finger 83. Those skilled in the art will recognize that the extrudate leaving the slot outlet opening of the extrusion die assembly 44 will be supported upon the upper surface of the base member 71, the upper surface of the right and left outwardly extending arms 74, 75 and the upper surface of the outwardly extending right and left fingers 82, 83. The guide former 46B is supported by a bracket, not shown, which attaches the base member 71 to the rack which supports the cooling fans 47 below the extrudate 45.

Those skilled in the art will recognize that since the polycarbonate melt enters the extrusion die assembly 44 of FIG. 5 at a temperature in excess of 500° F., while the polyvinylchloride melt enters the extrusion die assembly at a temperature of about 350° F., a thermal imbalance exists within the extrusion die assembly. It is important that the upper portion of the extrusion die assembly not be excessively chilled. The polycarbonate must not be allowed to cool to the point where it may gel and set up within the extrusion die assembly, thereby plugging the die and requiring a premature shutdown of the extrusion process. In contrast, it is important that the lower portion of the extrusion die assembly not be greatly elevated in temperature because it is important to avoid thermal decomposition of the polyvinylchloride. In order to prevent the charring or other decomposition of the polyvinylchloride melt or the chilling of the polycarbonate melt, a special construction of the extrusion die assembly is necessary. A first embodiment of a suitable extrusion die assembly is described hereinbelow in reference to FIGS. 8 through 11. A second embodiment of a suitable extrusion die assembly is discussed hereinbelow in reference to FIGS. 12 through 15.

Figure 8:
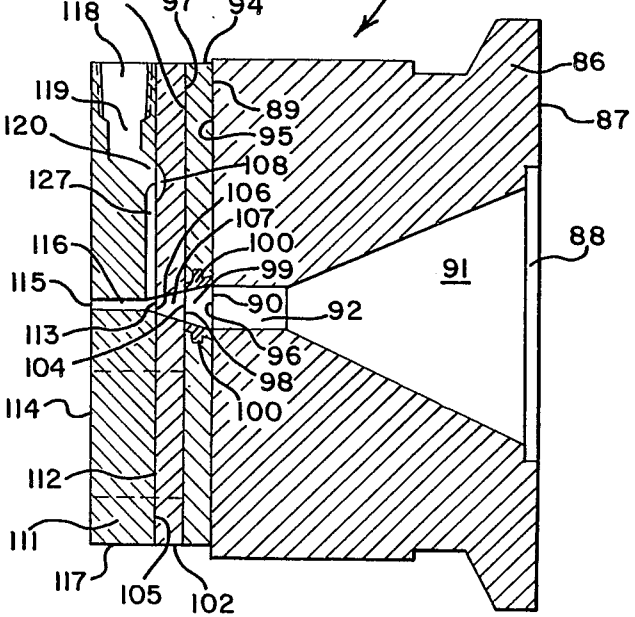
FIG. 8 is a simplified schematic cross-sectional side elevational view of a first extrusion die assembly, which is not a true sectional view, but which is shown as a schematic section for purposes of clarity.

FIG. 8 is a simplified schematic cross-sectional side elevational view of the first extrusion die assembly of the present invention. This Figure is not a true sectional view, but it is shown as a schematic section for purposes of clarity. Referring now to FIG. 8, there is shown an extrusion die assembly 85. The extrusion die assembly is composed of a gate member 86, an insulating member 94, an adapter member 102, and a die body member 111 Means of attaching the members to each other, such as screws or bolts, are not shown for purposes of clarity.

The gate member 86 has a cylindrical structure. The polyvinylchloride resin melt enters the die assembly 85 via the gate member. The gate member has an inlet face 87 which has a circular inlet opening 88, and an outlet face 89 which has a slot outlet opening 90. It will be seen that the outlet opening 90 is a slot configuration which has a height which is smaller than the diameter of the inlet opening 88. The gate member 86 also contains a central passageway. The inlet section 91 of the central passageway is reduced in size from the circular inlet opening 88 to a slot configuration. The outlet section 92 of the central passageway passes from the inlet section in a slot configuration to the slot outlet opening 90 in the outlet face 89.

The circular insulating member 94 is mounted on the outlet face 89 of the gate member 86. The insulating member has an inlet face 95 which is adjacent to the outlet face 89 of the gate member. A slot inlet opening 96 is in the inlet face 95 of the insulating member. Slot inlet opening 96 is contiguous with the slot outlet opening 90 of the gate member and is substantially congruent with the gate member slot outlet opening. The insulating member also has an outlet face 97 which contains a slot outlet opening 98 which has a height which is smaller than the height of the slot inlet opening 96. A central passageway 99 passes between the insulating member slot inlet opening 96 and the slot outlet opening 98. Because the insulating member is not fabricated of a structurally strong material, a metallic bushing 100 surrounds the central passageway 99 of the insulating member in order to prevent erosion.

Adapter member 102 is mounted on the outlet face 97 of the insulating member 94. The adapter member has an inlet face 103 which is adjacent to the outlet face 97 of the insulating member 94. Inlet face 103 contains a slot inlet opening 104 which is contiguous with the slot outlet opening 98 of the insulating member and which is also congruent with the slot opening 98 of the insulating member. The adapter member 102 also has an outlet face 105 which contains a slot outlet opening 106. Between the adapter member slot inlet opening 104 and the slot outlet opening 106, there is a central passageway 107. It will be seen that the height of the slot outlet opening 106 is smaller than the height of the slot inlet opening 104 for the adapter member 102.

Die body member 111 is mounted on the outlet face 105 of the adapter member 102. The die body member 111 has an inlet face 112 which is adjacent to the outlet face 105 of the adapter member 102. The inlet face 112 contains a slot inlet opening 113 which is contiguous with and congruent with the slot outlet opening 106 of the adapter member 102. Die body member 111 also has an outlet face 114 which contains a slot outlet opening 115. Slot outlet opening 115 has a height which is less than the height of the slot inlet opening 113. A central passageway 116 is within the die body member 111 between the slot inlet opening 113 and the slot outlet opening 115. The die body member has a peripheral surface 117 which contains a peripheral inlet opening 118 located at the top of the die body member. The polycarbonate resin melt enters the extrusion die assembly 85 via the peripheral inlet opening 118. The peripheral inlet opening is in communication with a peripheral inlet passageway 119 which terminates in a vertex outlet opening 120 on the inlet face of the die body member. It will be seen in FIG. 8 that the vertex outlet opening 120 of the die body member is contiguous with and substantially congruent with the vertex recess 108 in the outlet face of the adapter member 102. The vertex recess 108 of the adapter member provides a transition for the flow of polycarbonate which enters at the peripheral inlet opening 118 and flows through the peripheral inlet passageway 119. The vertex outlet opening 120 in combination with the vertex recess 108 of the adapter member allows the flow direction for the polycarbonate to change in a manner which avoids excessive turbulence in the flow of the polycarbonate.

Figure 9:
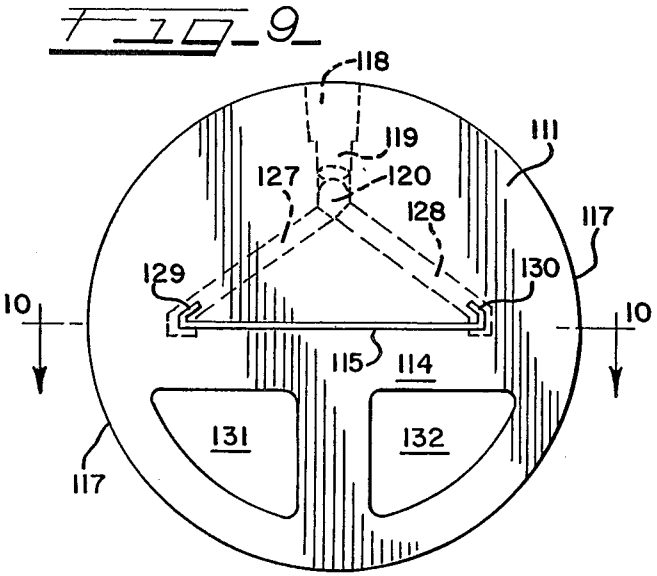
FIG. 9 is an end elevational view of the die body member of the first extrusion die assembly of FIG. 8.

Referring now to FIG. 9, the outlet face 114 of the die body member 111 is shown. FIG. 9 also shows the peripheral inlet opening 118, the peripheral inlet passageway 119, and the vertex outlet opening 120 in dotted configuration since these passageways and openings are within the structure of the die body member on its inlet face 112. The inlet face 112 of the die body member has a first recess 127 which is on the right side of the inlet face. This recess passes from the vertex outlet opening 120 to the central passageway 116 of the die body member at the inlet opening 113. This passageway 127 is shown in FIG. 8 as well as in FIG. 9. A second recess 128 on the left side of the inlet face 112 of the die body member passes from the vertex outlet opening 120 to the left side of the central passageway at the inlet opening 113. The left side or second recess 128 does not appear on FIG. 8 but it is shown on FIG. 9.

Figure 10:
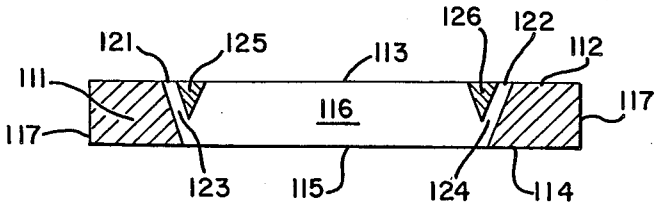
FIG. 10 is a simplified schematic cross-sectional plan view of the die body member of FIG. 9, as seen along section line 10—10.

As seen most clearly in FIG. 10, the first or right side recess 127 enters the central passageway 116 by means of a right side slot inlet opening 121 which communicates with a first side passageway 123 on the right side of the die body member. The right side passageway 123 joins the central) passageway 116 about halfway along the length of the central passageway. This is the point where the polycarbonate melt joins the polyvinylchloride melt in the central passageway 116 to provide a proper fusion interface on the right side of the extrudate which leaves via slot outlet opening 115. In a similar manner the second or left side recess 128 enters the central passageway 116 by means of a left side slot opening 122 and a left side passageway 124. The left side passageway 124 also enters the central passageway 116 at a position about half way through the length of the central passageway. This is the point where the polycarbonate melt joins the polyvinylchloride melt in the central passageway 116 to provide a proper fusion interface on the left side of the extrudate which leaves via slot outlet opening 115.

The right side passageway 123 is separated from the central passageway 116 by means of a first wedge shaped partition 125 located on the right side of the die body member central passageway. Similarly, the left side passageway 124 is separated from the central passageway 116 by means of the second wedge shaped partition 126 on the left side of the die body member. These right and left side wedge shaped partitions 125 and 126 may be an integral part of the structure of the die body member. However, it is preferable in fabricating the die body member to have these wedge shaped partitions 125 and 126 as separate elements which are fitted into the cut of the central passageway 116 and either welded or otherwise fixedly secured in position.

Referring again to FIG. 9, it will be seen that the central passageway exits the outlet face 114 of the die body member via outlet opening 115. The outlet opening 115 has a turned back first end 129 on the right side which provides a C-shape for the polycarbonate extrudate. The slot opening 115 also has a turned back second end 130 on the left side to provide a reversed C-shape. As used herein the term "C-shape" is defined to include a conventional C-shape as well as a C-shape which is a reversed or mirror image of the conventional C-shape. It can be seen in FIG. 9 that the upper element of the C-shape is preferably elevated at an angle. That is to say, the turned back ends 129 and 130 of the slot outlet opening 115 are inclined upwardly. Peferably, this angle is about 45 degrees. This upward incline helps to compensate for the fact that the polycarbonate melt will tend to fall downwardly due to the force of gravity as it exits from the outlet face 114.

FIG. 9 also shows that the die body member 111 contains a right side open section 131 and a left side open section 132. These open sections provide for air cooling of the die body member. In addition, the adapter member 102 contains equivalent open sections which are congruent with the open sections of the die body member. The open sections of the adapter member 102 are not seen in FIG. 9, but they are illustrated in FIG. 8 by means of the dotted lines at the bottom of the adapter member.

Figure 11:
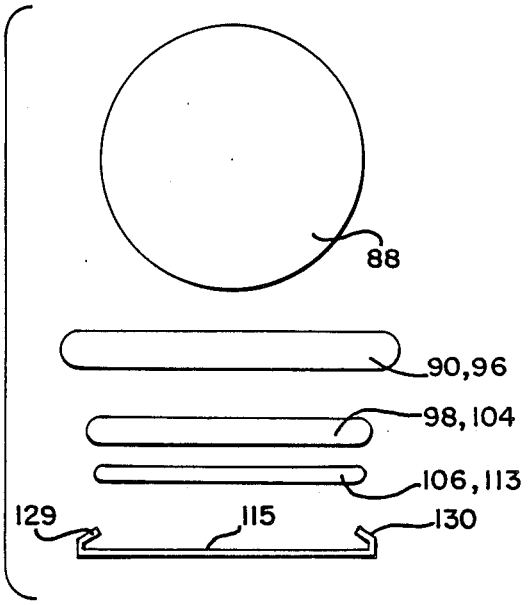
FIG. 11 is a simplified schematic representation of the relative size and shape of the inlet and outlet openings for the central passageway in the various members of the first extrusion die assembly of FIG. 8.

FIG. 11 is a simplified schematic representation showing the relative size and shape of the inlet and outlet openings for the central passageway in the various members of the first extrusion die assembly of FIGS. 8–10. At the top of FIG. 11, there is shown the gate member inlet opening 88 which has a circular shape. Below the inlet opening 88, there is shown a slot opening which represents the size and shape for the gate member slot outlet opening 90 and the insulating member slot inlet opening 96. It will be noted that this opening 90, 96 has a height substantially less than the diameter of the gate member inlet opening 88, and that it has a width which is substantially greater than the diameter of the gate member inlet opening 88. Below the slot opening 90, 96 there is shown the slot opening for the insulating member slot outlet opening 98 and the adapter member slot inlet opening 104. This slot opening 98, 104 has a height which is substantially less than the height of the slot opening 90, 96 and it has a width which is substantially less than the width of the slot opening 90, 96. Below the slot opening 98, 104, there is seen the slot opening for the adapter member slot outlet opening 106 and the die member slot inlet opening 113. The slot opening 106, 113 has a height which is less than the height of the slot opening 98, 104, and it has a width which is slightly less than the width of the slot opening 98, 104. Below the slot opening 106, 113, there is shown the die body member slot outlet opening 115, which has a turned back first end 129 on its right side and a turned back second end 130 on its left side. It will be seen that the die body member slot outlet opening 115 has a height which is less than the height of the slot opening 106, 113 and that the width of the die body member slot outlet opening 115 is slightly larger than the width of slot opening 106, 113.

It will be seen in FIG. 11 that each of the openings has a height which is less than the height of the opening shown immediately above it. This is necessary in order to have a smooth transition in the size of the central passageway from member to member in order to maintain laminar flow of the plastic melt within the central passageways as the plastic melt passes from the gate member inlet opening 88 to the die body member slot outlet opening 115. However, the width of the various slot openings is not a critical dimension and may be varied from what is illustrated in FIG. 11. For example, the gate member inlet opening 88 is circular and the gate member slot outlet opening 90 may have a width which is substantially equal to the diameter of the circular inlet opening 88. Alternatively, the gate member slot outlet opening may have a width which is greater than the width of the gate member inlet opening or it may be smaller.

Figure 12:
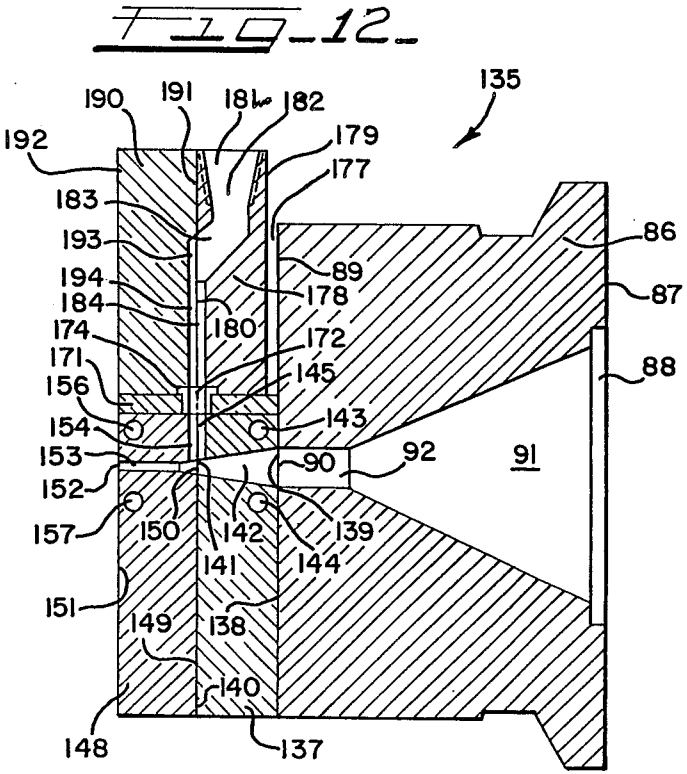
FIG. 12 is a simplified schematic cross-sectional side elevational view of a second extrusion die assembly, which is not a true sectional view, but which is shown as a schematic section for purposes of clarity.

FIG. 12 is a simplified schematic cross sectional side elevational view of the second extrusion die assembly of the present invention. This Figure is not a true sectional view, but it is shown as a schematic section for purposes of clarity. Referring to FIG. 12, there is shown an extrusion die assembly 135. The extrusion die assembly is composed of a gate member 86, a lower adapter member 137, a lower die body member 148, an insulating member 171, an upper adapter member 178, and an upper die body member 190. Means of attaching the members to each other, such as screws or bolts, are not shown for purposes of clarity.

The gate member 86 of the extrusion die assembly 135 is identical to the gate member 86 which was utilized in the first extrusion die assembly 85 which is shown in FIGS. 8 through 10. The gate member has a cylindrical structure with an inlet face 87 having a circular inlet opening 88, and an outlet face 89 which has a slot outlet opening 90. The outlet opening 90 is a slot configuration which has a height which is smaller than the diameter of the inlet opening 88. The gate member 86 contains a central passageway which consists of an inlet section 91 which is reduced in size from the circular inlet opening 88 to a slot configuration. The outlet section 92 of the central passageway passes from the inlet section 91 in a slot configuration to the slot outlet opening 90 n the outlet face 89.

A lower adapter member 137 having a rectangular shape is mounted on the outlet face 89 of the gate member 86 at the lower portion of the outlet face. The lower adapter member has an inlet face 138 which is adjacent to the lower portion of the outlet face 89 of the gate member. A slot inlet opening 139 is contained in the inlet face 138 of the lower adapter member. The lower adapter member has an outlet face 140 containing a slot outlet opening 141. The slot inlet opening 139 is contiguous with the slot outlet opening 90 of the gate member 86 and is substantially congruent with the gate member slot outlet opening 90. The slot outlet opening 141 has a height which is smaller than the height of the slot inlet opening 139. A central passageway 142 passes between the slot inlet opening 139 and the slot outlet opening 141.

The lower adapter member 137 also has an upper transverse cooling passageway 143 and a lower transverse cooling passageway 144. The cooling passageways are shown in FIG. 12, but they are seen most clearly in FIG. 13, where it can be seen that the upper and lower passageways are joined at the left side of the adapter member to form, in fact, a single cooling passageway. Additionally, the lower adapter member has a first inlet recess 145 on the right side of the outlet face 140 and a second inlet recess 146 on the left side of the outlet face 140. The inlet recesses 145 and 146 are seen most clearly in FIG. 13. Only the inlet recess 145 on the right side of the outlet face 140 is shown in FIG. 12.

A rectangular lower die body member 148 is attached to the outlet face 140 of the lower adapter member 137.

The lower die body member has an inlet face 149 which is adjacent to the outlet face 140 of the lower adapter member. The lower die body member inlet face 149 contains a slot inlet opening 150 which is contiguous with the slot outlet opening 141 of the lower adapter member and which is substantially congruent with the shape of the slot outlet opening 141. The lower die body member additionally has an outlet face 151 containing a slot outlet opening 152. The slot outlet opening 152 has a height which is smaller than the height of the slot inlet opening 150. A central passageway 153 passes from the slot inlet opening 150 to the slot outlet opening 152.

The lower die body member has a upper transverse cooling passageway 156 and a lower transverse cooling passageway 157. The cooling passageways 156 and 157 are shown on FIG. 12, but they are seen more clearly on FIG. 13, where it can be seen that the upper and lower passageways are joined at the left side of the lower die body member to form, in fact, a single cooling passageway. Additionally, the lower die body member 148 has a first inlet recess 154 on the right side of the inlet face 149, and a second inlet recess 155 on the left side of the inlet face. The inlet recesses 154 and 155 are seen most clearly in FIG. 13. Only the first inlet recess 154 on the right side of the inlet face is shown in FIG. 12.

Figure 14:
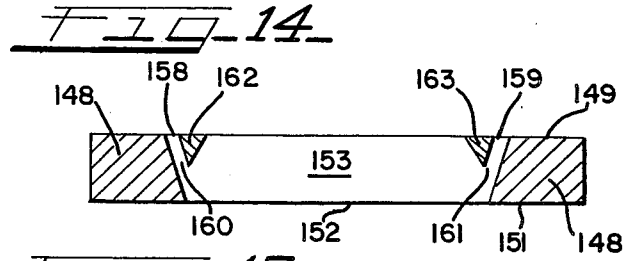
FIG. 14 is a simplified schematic cross-sectional plan view of the lower die body member of FIG. 13, as seen along section line 14—14.

FIG. 14 is a sectional plan view which illustrates the slot inlet and outlet openings of the lower die body member 148 and the central passageway 153. The lower die body member 148 has a first side slot inlet opening 158 on the right side of the inlet face 149, and a second side slot inlet opening 159 on the left side of the inlet face 149. A first wedge shaped partition 162 is on the right side of the inlet face 149 and a second wedge shaped partition 163 is on the left side of the inlet face. The wedge shaped partition 162 forms a first side passageway 160 on the right side of the central passageway 153 and the wedge shaped partition 163 forms a second side passageway 161 on the left side. The side passageways 160 and 161 join the central passageway 153 about half way along the length of the central passageway. This is the point where the polycarbonate resin melt joins the polyvinylchloride resin melt in the central passageway 153 to provide a proper fusion interface on the right and left sides of the extrudate which finally exits from the slot opening 152. The wedge shaped partitions may be formed as a integral part of the structure of the lower die body member 148. However, it is preferred for ease of fabrication that the wedge shaped partitions 162 and 163 be fabricated as separate elements which are inserted into the central passageway 153 to form the side slot inlet openings 158 and 159 and the side passageways 160 and 161.

Figure 13:
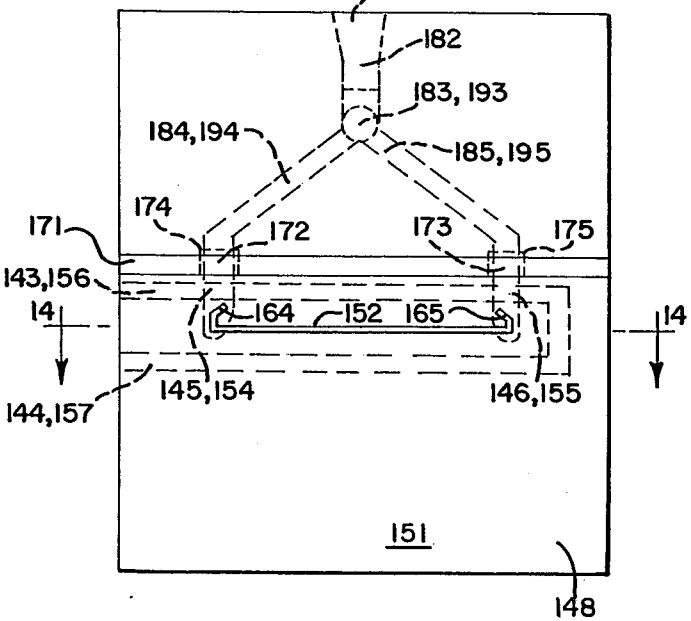
FIG. 13 is an end elevational view of the second extrusion die assembly of FIG. 12 with the gate member not shown for purposes of clarity.

As seen most clearly in FIG. 13, the lower die body member 148 has a slot outlet opening 152 which has a turned back first end 164 on the right side of the slot outlet opening to provide a C-shape. Additionally, the slot outlet opening 152 has a second turned back end 165 on the left side which provides a reversed or mirror image C-shape. It can be seen in FIG. 13 that the upper element of the C shape is preferably elevated at an angle. That is to say, the turned back ends 164 and 165 are inclined upwardly at an angle which is, preferably, about 45 degrees. This incline helps to compensate for the fact that the polycarbonate melt will tend to fall downwardly due to the force of gravity as it exits from the outlet face 151.

The extrusion die assembly 135 also contains a rectangular insulating member 171 which is mounted on the top of the rectangular lower adapter member 137 and the rectangular lower die body member 148. The insulating member has a first aperture 172 on the right side which is in communication with the right side inlet recess 145 of the lower adapter member and the right side inlet recess 154 of the lower die body member. Additionally, the insulating member has a second aperture 173 on the left side which is in communication with the lower adapter member left side inlet recess 146 and the lower die body member left side inlet recess 155. This is seen most clearly in FIG. 13. A first bushing 174 encompasses the first aperture 172 on the right side of the insulating member and a second bushing 175 encompasses the second aperture 173 on the left side of the insulating member. These bushings are metallic and they serve to protect the softer insulating member from erosion.

A rectangular upper adapter member 178 is mounted on the insulating member 171 above the lower adapter member 137. The upper adapter member has an inlet face 179 and an outlet face 180. The inlet face 179 is spaced away from the upper portion of the outlet face 89 of the gate member 86. The space 177 between the upper adapter member and the gate member provides a means for keeping the upper adapter member isolated from the gate member so that a minimum loss of heat from the upper adapter member 178 will occur. The upper adapter member has a peripheral inlet opening 181 at the top. The peripheral inlet opening communicates with a peripheral inlet passageway 182 by means of which the melt of polycarbonate will enter the extrusion die assembly 135. The peripheral inlet passageway 182 terminates in a vertex outlet opening 183 at the outlet face 180 of the upper adapter member. The vertex outlet opening communicates with a first inlet recess 184 on the right side of the outlet face 180 and a second inlet recess 185 on the left side of the outlet face 180. The inlet recesses 184 and 185 pass downwardly at an angle along the outlet face 180 until they reach the right and left side apertures 172- and 173 of the insulating member 171. This is shown most clearly in FIG. 13. Only the first inlet recess 184 on the right side of outlet face 180 is shown in FIG. 12.

The extrusion die assembly 135 also has an upper die body member 190 which is mounted on top of the insulating member 171 above the lower die body member 148. The upper die body member 190 has an inlet face 191 which is adjacent to the outlet face 180 of the upper adapter member 178. It also has an outlet face 192. The inlet face 191 contains a vertex recess 193 at the upper region which is contiguous and congruent with the vertex outlet opening !83 of the upper adapter member 178. The vertex recess 193 communicates with a first inlet recess 194 on the right side of inlet face 191 and a second inlet recess 195 on the left side of inlet face 191. The first inlet recess is contiguous and congruent with the first inlet recess 184 of the upper adapter member 178 and these two inlet recesses provide a flow passageway for the polycarbonate melt to pass along the right side of the extrusion die assembly to the first aperture 172 on the right side of the insulating member. The second inlet recess 195 on the left side of the inlet face 191 is contiguous and congruent with the second inlet recess 185 of the upper adapter member 178. The second inlet recess 195 of the upper die body member and the second inlet recess 185 of the upper adapter member provide a fluid passageway for polycarbonate melt to pass downwardly from the vertex outlet opening 183 of the upper adapter member to the second aperture 173 on the left side of the insulating member 171. In this manner the polycarbonate melt will pass downwardly into the lower die body member.

FIG. 13 more clearly shows the flow system for the polycarbonate melt. FIG. 13 is a front elevational view of the upper and lower die body members and the upper and lower adapter members with the insulating member therebetween. For purposes of clarity the gate member 86 is not shown.

FIG. 13 shows the peripheral inlet opening 181 of the upper adapter member 178 in communication with the peripheral inlet passageway 182 of the upper adapter member. It will be seen that the passageways for the polycarbonate melt are shown as dotted lines since they are internal within the structure of the upper and lower adapter members and the upper and lower die body members. The peripheral inlet passageway 182 terminates in the vertex outlet opening 183 of the upper adapter member 178 and the vertex recess 193 of the upper die body member 190. The polycarbonate passageway then splits into a right and a left hand passageway.

The right hand passageway is comprised of the first inlet recess 184 on the right side of the upper adapter member outlet face 180 and the first inlet recess 194 on the right side of the upper die body member inlet face 191. This passageway 184, 194 communicates with the first aperture 172 of the insulating member 171. The passageway continues downwardly as the first inlet recess 145 on the right side of the lower adapter member 137 and the first inlet recess 154 on the right side of the lower die body member 148. Although not seen in FIG. 13, this right side passageway 145, 154 terminates in the first side slot inlet opening 158 on the right side of the inlet face 149 of the lower die body member.

In a similar manner, the polycarbonate melt is passed to the left side of the extrusion die assembly via the second inlet recess 185 on the left side of the upper adapter member 178 and the second inlet recess 195 on the left side of the upper die body member 190. This passageway 185, 195 communicates with the second aperture 173 on the left side of the insulating member 171. The passageway continues downwardly as the second inlet recess 146 on the left side of the lower adapter member 137 and the second inlet recess 155 on the left side of the lower die body member 148. Although not seen in FIG. 13, the left side passageway 146, 155 terminates in the second side slot inlet opening 159 at the left side of the inlet face 149 of the lower die body member.

Figure 15:
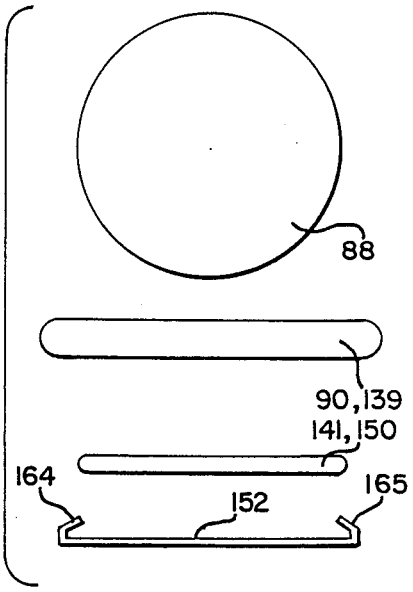
FIG. 15 is a simplified schematic representation of the relative size and shape of the inlet and outlet openings for the central passageway in the various members of the second extrusion die assembly of FIG. 12.

FIG. 15 is a simplified schematic representation which illustrates the relative size and shape of the inlet and outlet openings for the central passageway in the various members of the second extrusion die assembly !35 of FIGS. 12–14. FIG. 15 illustrates the circular inlet opening 88 for the gate member 86. Below the inlet opening 88 is shown the slot opening 90, 139 which represents the size and shape of the slot outlet opening 90 of the gate member 86, and the slot inlet opening 139 of the lower adapter member 137. Below the slot opening 90, 139 is a smaller slot opening 141, 150 which represents the slot outlet opening 141 of the lower adapter member 137 and the slot inlet opening 150 of the lower die body member 148. It will be noted that the slot opening 141, 150 has a height which is smaller than the height of the slot opening 90, 139, and that it has a width which is also smaller. Below the slot opening 141, 150 is shown the relative size and shape of the slot outlet opening 152 of the lower die body member with its turned back first end 164 on the right side and its turned back second end 165 on its left side. It will be noted that the slot opening 152 has a height which is smaller than the height of the slot opening 141, 150 but that its width is substantially greater than the width of slot opening 141, 150.

It will be seen in FIG. 15 that each of the openings has a height which is less than the height of the opening shown immediately above it. This is necessary in order to have a smooth transition in the size of the central passageway from member to member in order to maintain laminar flow of the plastic melt within the central passageways as the plastic melt passes from the gate member inlet opening 88 to the die body member slot outlet opening 152. However, the width of the various slot openings is not a critical dimension and may be varied from what is illustrated in FIG. 11. For example, the gate inlet opening is circular and the gate member slot outlet opening may have a width which is substantially equal to the diameter of the circular inlet opening 88. Alternatively, the gate member slot outlet opening may have a width which is greater than the width of the gate member inlet opening or it may be smaller.

Figure 16:
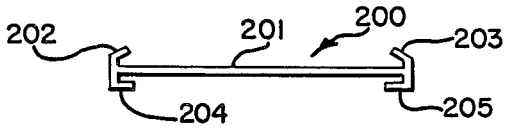
FIG. 16 is a simplified schematic representation of the slot outlet opening in a die body member for producing a louver slat having double groove side edges.

FIG. 16 is a simplified schematic representation of the slot outlet opening in a die body member for producing a louver slat having double groove side edges. In FIG. 16 there is shown an extrusion die slot outlet opening 200 having a central slot opening 201. The central slot opening has a right upper end return slot 202 and a right lower end return slot 204. Additionally, the central slot opening 201 has a left upper end return slot 203 and a left lower end return slot 205. It will be seen that the right end return slots form an E-shape and that the left return slots form a reversed E-shape. As used herein, the term "E-shape" is defined to include the E-shape shown in FIG. 16 on the right side as well as the reversed or mirror image E-shape which is shown on the left side of the slot outlet opening 200. It will be seen that the upper end return slots 202 and 203 are elevated at an angle from the horizontal. Preferably this angle is about 45 degrees. As noted hereinabove the provision of the upper end return slots 202 and 203 at an angle is made because the melt extruded from the opening will tend to fall downwardly due to the force of gravity.

The extrusion die assemblies 85 and 135 which have been discussed hereinabove are typically made of a conventional tool steel. The insulating members which are utilized may be fabricated of any appropriate insulating material. One preferred insulating material is D—M—E Standard High Temperature Insulator Sheet which can be obtained from D—M—E Company, Madison Heights, Michigan 48071. This is an asbestos-free, glass-reinforced polymer composite having excellent non-deformation characteristics and compressive strength. The sheets are readily machineable using conventional high speed cutting tools.

The cooling passageways 143, 156 and 144, 157 which are found in the extrusion die assembly 135 (FIGS. 12 and 13) may be used in conjunction with any flowable fluid which is capable of removing heat from the extrusion die assembly. One preferred fluid is a heat transfer liquid called U-CON which is supplied by Union Carbide Corporation, Danbury, Connecticut. It is a water soluble oil which is suitable for heat transfer service at temperatures of up to 600° F.

The polyvinylchloride (PVC) which is utilized in the grooved vane or louver slat of the present invention is a conventional rigid vinyl of the type which has been used in extruding the pigmented base web or central section 22 and 32 of the louver for many years. One such rigid vinyl which is suitable for this service is Geon 87384 which is an opaque material. The Geon is a general purpose, interior, normal impact, rigid profile extrusion PVC for thin wall applications. It is extruded at a melt temperature in the range of from about 350° to 400° F. on low or high shear extrusion equipment. The Geon resin is supplied by the BFGoodrich Company, Chemical Group, Cleveland, Ohio 44131.

The clear transparent polyvinylchloride which has been utilized in the past for the grooved side edges of the vane or louver slat is also a conventional rigid vinyl. One suitable rigid vinyl is supplied by Colorite Plastics Company of Ridgefield, New Jersey 07657. This PVC resin is UV stabilized.

As pointed out hereinabove, the clear transparent polycarbonate is a novel substitute for the clear transparent polyvinylchloride previously used in the vertical blind louver having the slotted edges. The polycarbonate is a clear transparent resin having enhanced resistance to sunlight and, in particular, to the ultraviolet component of the sunlight. One suitable polycarbonate is Lexan 103 Resin which is supplied by General Electric Company, Plastics Group, Lexan Products Division, Pittsfield, Massachusetts 01201. The Lexan 103 grade resin is a high viscosity improved UV stabilized resin for outdoor and lighting applications. An alternate resin which can be used is Lexan 153 which is also UV stabilized.

EXAMPLE 1

Samples of clear polycarbonate were compared with samples of clear polyvinylchloride in an accelerated weathering test. The accelerated weathering equipment was purchased from Q-Panel Company of Cleveland, Ohio 44145. The test equipment is known as the Q—U—V Accelerated Weathering Tester. This device tests the plastic samples under accelerated aging conditions which include exposure to ultraviolet radiation in the range of from 280 to 400 nanometers. This range of ultraviolet radiation is selected because this is the range in which most polymer damage occurs.

The results of the accelerated weathering tests are presented in Table 1. Table 1 shows the correlation of color change with total time exposed to the UV radiation. It will be seen that the polycarbonate sample (Lexan 103-112) is far superior to the clear transparent polyvinylchloride (Colorite 1417-013). At 348.8 total hours of exposure, the polyvinylchloride had a 4 ranking which means that a slight color change was apparent. In comparison, at the higher total time of 380.9 hours, the polycarbonate sample had a color ranking of 5 which indicates negligeable or no color change. At a time of exposure of 444.6 hours, the polyvinylchloride had deteriorated to a rating of 3 which means that a noticeable color change was evident. In comparison, at a total time exposure of 497.8 hours, the polycarbonate had a rating of 4 which means slight color change was apparent. At 540.4 total hours, the polyvinylchloride had deteriorated to a rating of 2 which means a considerable color change was evident. In comparison, the polycarbonate had a rating of 3, meaning a noticeable color change, at a total time of exposure of 594.6 hours. Thus, when one looks at the actual color rating, there is a significant difference between the clear polycarbonate and the clear polyvinylchloride. While one cannot estimate from this accelerated weathering data how long clear polycarbonate will stay clear in actual use in a window, it is apparent that the clear polycarbonates are a much superior product in comparison to the clear polyvinylchloride which is currently being utilized. In both cases the clear polycarbonate resin and the clear rigid polyvinylchloride resin were obtained from the suppliers with UV stabilizers contained in the resins.

TABLE 1

| | Color Change With UV Exposure | |
|---|---|---|
| UV Exposure Total Hours | Polycarbonate LEXAN 103-112 | Polyvinylchloride COLORITE 1417-013 |
| 113.7 | 5 | — |
| 189.6 | 5 | — |
| 285.6 | 5 | — |
| 348.8 | — | 4 |
| 380.9 | 5 | — |
| 444.6 | — | 3 |
| 497.8 | 4 | — |
| 540.4 | — | 2 |
| 594.6 | 3 | — |
| 636.2 | — | 2 |
| 732.0 | — | 1 |
| 827.8 | — | 1 |

Color Change Code:
5 Negligible or no color change
4 Slight color change
3 Noticeable color change
2 Considerable color change
1 Severe color change

EXAMPLE 2

Several extrusion runs were made using an experimental extrusion die assembly. The experimental extrusion die assembly was similar to the first extrusion die assembly which has been disclosed hereinabove in regard to FIGS. 8 through 10. One major difference was that the experimental extrusion die assembly did not contain an insulating member.

The first run was begun by putting molten polyvinylchloride into the extrusion die assembly. The polyvinylchloride plugged up the extrusion die assembly and the unit had to be shut down. It was concluded from this run that the Lexan polycarbonate must be passed into the extrusion die assembly first in order to make sure that the metal is heated enough in order to keep the polyvinylchloride in a molten state when it is passed into the die assembly.

EXAMPLE 3

The second run was undertaken with the main extruder showing four zone temperatures of 290° F., but the gate member showed a temperature of 340° F. for the polyvinylchloride entering the experimental extrusion die assembly. This indicates that the zone temperatures of the main extruder were actually higher than the 290° F. readings. The coextruder for the polycarbonate resin had zone temperatures of 552°, 559° and 565° F. The adapter member had a temperature of 569° F. and the die body member showed a temperature of 524° F. Some difficulty was experienced due to cooling of the die body member. The upper portion of the die body member had to be periodically heated with a torch (open flame). However, the run was able to make acceptable extrudate.

EXAMPLE 4

In the third run the main extruder for the PVC resin had zone temperatures of 298°, 301°, 300°, and 299° F., but the gate member showed a temperature of 367° F. The coextruder for the polycarbonate resin had zone temperatures of 499°, 517°, and 529° F. and the adapter showed a temperature of 530° F. The Lexan polycarbonate exited the die at 460° F. and the polyvinylchloride exited the die at 403° F. The extrudate which was produced under these conditions did not have proper fusion interfaces between the polycarbonate and the polyvinylchloride.

EXAMPLE 5

The operation of the foregoing third run (Example 4) was continued with zone temperatures of the coextruder being increased to 495°, 518°, and 532° F. The adapter temperature was 549° F. The Lexan melt in the die was 482° F. and the polyvinylchloride exited the die at 411° F. At this temperature level, the extrusion process produced an extrudate which had proper fusion interfaces between the polycarbonate and the polyvinylchloride. The extrusion process was run for several hours at a rate of up to 25 feet per minute. This run was considered to be a successful operation.

In light of the foregoing disclosure, further alternative embodiments of the inventive grooved louver and the extrusion dies will undoubtedly suggest themselves to those skilled in the art. It is thus intended that the disclosure be taken as illustrative only and that it not be construed in any limiting sense. Modifications and variations may be resorted to without departing from the spirit and the scope of this invention, and such modifications and variations are considered to be within the purview and the scope of the appended claims.

The invention claimed:

1. A slat, suitable for use as a drapery louver, having an upper surface and a lower surface, having first and second ends, having a central section composed of a first chemical composition having a first melt temperature, and having first and second side edges composed of a second chemical composition having a second melt temperature substantially different from the first melt temperature, wherein said side edges are fused to said central section each side edge contains a longitudinal groove open to the central section, and said grooves open to the same surface of said slat.

2. A slat according to claim 1 wherein said second melt temperature is substantially lower than said first melt temperature.

3. A slat according to claim 1 wherein said second melt temperature is substantially higher than said first melt temperature.

4. A slat according to claim 3 wherein said second melt temperature is at least about 100° F. higher than said first melt temperature.

5. A slat according to claim 4 wherein said second melt temperature is about 150° F. higher than said first melt temperature.

6. A slat according to claim 1 wherein said first and second chemical compositions comprise thermoplastic polymers.

7. A slat according to claim 6 wherein said first composition is a polyvinylchloride.

8. A slat according to claim 6 wherein said second composition is a polycarbonate.

9. A slat, suitable for use as a drapery louver, having an upper surface and a lower surface, having first and second ends, having an opaque central section composed of a first chemical composition having a first melt temperature, and having transparent first and second side edges composed of a second chemical composition having a second melt temperature substantially greater than said first melt temperature, wherein said side edges are integrally fused to said central section, each side edge contains a longitudinal groove open to said central section, and said grooves open to the same surface of said slat.

10. A slat according to claim 9 wherein said second melt temperature is at least about 100° F. above said first melt temperature.

11. A slat according to claim 10 wherein said second melt temperature is about 150° F. above said first melt temperature.

12. A slat according to claim 9 wherein said first and second compositions comprise thermoplastic polymers.

13. A slat according to claim 12 wherein said second melt temperature is at least about 100° F. above said first melt temperature.

14. A slat according to claim 13 wherein said first composition comprises a polyvinylchloride and said second composition comprises a polycarbonate.

15. A slat according to claim 9 wherein each side edge contains upper and lower longitudinal slots open to said central section, each upper slot opens to the upper surface of said slat, and each lower slot opens to the lower surface of said slat.

16. A slat according to claim 15 wherein said second melt temperature is at least about 100° F. above said first melt temperature.

17. A slat according to claim 16 wherein said second melt temperature is about 150° F. above said first melt temperature.

18. A slat according to claim 15 wherein said first and second compositions comprise thermoplastic polymers.

19. A slat according to claim 18 wherein said second melt temperature is at least about 100° F. above said first melt temperature.

20. A slat according to claim 19 wherein said first composition comprises a polyvinylchloride and said second composition comprises a polycarbonate.

* * * * *

UNITED STATES PATENT AND TRADEMARK OFFICE

CERTIFICATE OF CORRECTION

PATENT NO. : 4,884,616

DATED : December 5, 1989

INVENTOR(S) : Richard A. Setele

It is certified that error appears in the above-identified patent and that said Letters Patent is hereby corrected as shown below:

Column 3, line 6, "melting" should be --melt--.

Column 7, line 44, delete first "FIG.".

Column 9, line 2, add "." after --member 111--.

Column 10, line 36, "central)" should be --central--.

Column 12, line 36, "n" should be --in--.

Column 14, line 40, delete "-" after "172".

Column 14, line 52, "!83" should be --183--.

Column 15, line 56, "!35" should be --135--.

Signed and Sealed this

Twelfth Day of February, 1991

*Attest:*

*Attesting Officer*

HARRY F. MANBECK, JR.

*Commissioner of Patents and Trademarks*